United States Patent [19]

Worrall

[11] 3,996,086

[45] Dec. 7, 1976

[54] FORMING METHOD

[75] Inventor: Brian Stanley Worrall, Sutton Coldfield, England

[73] Assignee: Expert Industrial Controls Limited, Ashby-De-La-Zouch, England

[22] Filed: Aug. 12, 1975

[21] Appl. No.: 603,995

[30] Foreign Application Priority Data

Aug. 22, 1974 United Kingdom ..... 36892/74

[52] U.S. Cl. ..... 156/194; 29/605; 156/443; 336/213

[51] Int. Cl.[2] ..... B65H 81/00

[58] Field of Search ..... 156/194, 189, 229, 443; 336/213, 225, 227, 228; 29/605

[56] References Cited

UNITED STATES PATENTS

| | | | |
|---|---|---|---|
| 2,477,350 | 7/1949 | Somerville | 336/213 X |
| 2,751,319 | 6/1956 | Carlson | 156/229 X |
| 3,327,373 | 6/1967 | Somerville | 29/605 |

FOREIGN PATENTS OR APPLICATIONS

| | | | |
|---|---|---|---|
| 1,222,713 | 2/1971 | United Kingdom | 29/605 |

*Primary Examiner*—David A. Simmons
*Attorney, Agent, or Firm*—Ladas, Parry, Von Gehr, Goldsmith & Deschamps

[57] ABSTRACT

A method of forming a rectangular laminated frame for an electro-magnetic device such as a solenoid includes forming a rectangular laminated frame. Formation of the frame includes winding a strip of material in spiral fashion to produce a generally annular blank and then subjecting the blank to a forming process. The forming process involves applying to the blank pressure in an outward direction at 4 spaced points on the inner peripheral surface of the blank. This applied to outward pressure deforms the blank to the required shape.

11 Claims, 5 Drawing Figures

FORMING METHOD

This invention relates to a method of forming a rectangular laminated frame for an electro-magnetic device such as a solenoid.

A conventional method of forming such a frame is to hand assemble the frame using individual laminations of special shapes. The resulting stack of laminations is held in assembled relationship by rivets or other fastening devices. Such an assembly is costly in terms of time required for assembly, and also costly in terms of material because of the need to form the laminations to special shapes. In addition, the magnetic performance of the resulting solenoid may be impaired by the need to secure the laminations together.

It is known to form such a frame by winding a strip of material around a former, the dimensions of the former corresponding with the window area of the resulting frame. Again, however, this process presents difficulties, particularly with the formation of the corners of the frame.

The object of the present invention is to provide a method and apparatus for forming a rectangular laminated frame in a simple and convenient manner.

According to the invention, a method of forming a rectangular laminated frame for an electro-magnetic device comprises winding a strip of material in spiral fashion to produce a generally annular frame blank, and subjecting said blank to a forming process which includes the step of applying pressure in an outward direction at four spaced points on the internal peripheral surface of the blank, thereby to deform the blank to the required shape.

According to a further feature of the invention, the method includes the additional step of applying pressure to the outer sides of the deformed blank or frame to square up the outer surfaces of the frame.

Preferably, the outer end of the strip is secured to the adjacent turn of the blank at the end of the winding operation.

Conveniently, the outer end of the strip is secured by projecting welding, the projections being formed on the strip during cutting of the strip to the desired length.

According to a further feature of the invention, at least one of the limbs of the frame is blanked to provide an aperture to receive an armature tube.

One example of the method of forming in accordance with the invention will now be described with reference to the accompanying drawings, in which.

Figure 1:
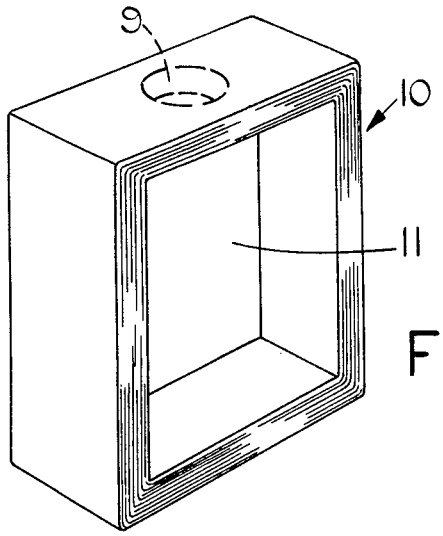
FIG. 1 shows a perspective view of a completed frame.

With reference to FIG. 1, the frame 10 is of rectangular shape, and has a window 11 in which in use, is located a solenoid winding perferably mounted about a tube in which is slidably accommodated an armature. Conveniently, at least one limb of the frame is provided with an aperture shown in outline at 9 through which extends the aforesaid tube. The frame is of laminated construction, and is formed from a continuous strip of material, the width of which is equal to the depth of the frame.

Figure 2:
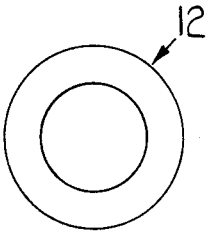
FIGS. 2, 3 and 4 show steps in the manufacture of the frame.
Figure 3:
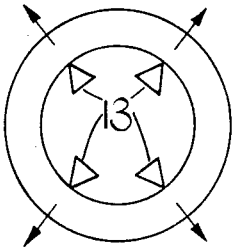
Figure 4:
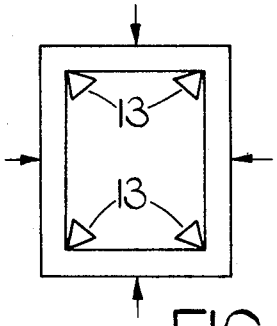
Figure 5:
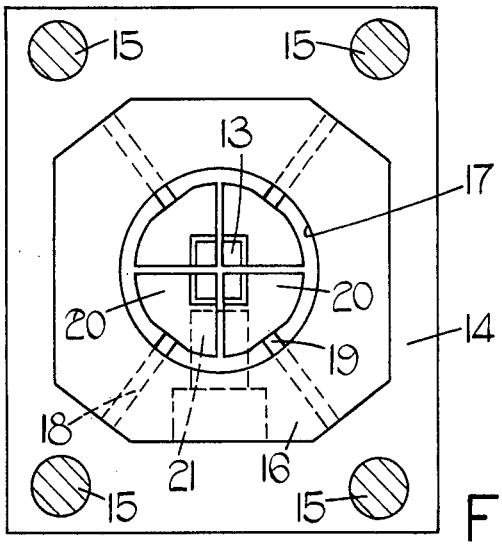
FIG. 5 shows a plan view of a tool for carrying out the method.

In forming the frame, a predetermined length of strip is first cut from a roll and is wound in spiral fashion about a cylindrical mandrel. The resulting blank 12 is of annular form and is shown in FIG. 2. Conveniently, the free end of the strip is projection welded to the adjacent turn of the blank, the projection necessary for such welding being formed during the process of cutting the predetermined length of material from the coil. It should be noted that the internal circumference of the blank 12 is equal to the inside perimeter of the completed frame 10.

The blank 12 is next placed in a tool which includes four shoes 13 which bear against the internal peripheral surface of the blank. The shoes are of generally triangular section with the apex of the shoe which engages the internal surface of the blank, being slightly rounded. In the tool, the shoes 13 are moved outwardly in predetermined directions, and the effect of such outward movement is to deform the blank into generally rectangular shape. During the movement of the shoes 13, no slipping occurs between the shoes and the internal peripheral surface of the blank.

Finally, whilst the blank is still in the aforesaid tool, pressure is applied to the outer peripheral side faces which has the effect of squaring up the sides of the frame so that it is of true rectangular form.

One pair of opposed limbs of the frame may be blanked to provide the aperture or apertures through which the aforesaid tube extends.

The initial position of the shoes and their direction and extent of movement can be readily calculated. The essential point to remember is that during the deformation process, no relative movement of the apices of the shoes and the internal peripheral surface of the blank occurs.

The resulting frame can be held to the required dimensional tolerances, and it will be appreciated that each one of the steps described is more or less automatic, requiring no intervention on the part of the operator.

one form of tool which is particularly suited to the production of the frame comprises a base plate 14 which is adapted to be secured to the upper surface of the lower platen (not shown) of a press conveniently an hydraulically actuated press. The base plate is provided with upstanding guide posts 15 which guide the movement of an upper plate adapted to be secured to the under surface of the upper platen of the press.

Mounted on the upper surface of the base plate is a guide block 16 in which is formed a central generally cylindrical aperture 17, and formed in the guide block are four guide bores 18 the axes of which are disposed substantially parallel to the base plate. Moreover, the guide bores are diametrically disposed relative to the axis of the aforesaid aperture 17, but the relative angles between the axes of the guide bores measured at the axis of the aperture, depends upon the shape required of the resulting frame. The guide bores accommodate guide pins 19 which at their inner ends carry carrier blocks 20 on which are defined the aforesaid shoes 13, the shoes extending upwardly of the main upper surfaces of the carrier blocks so that the annular frame blank can be placed about the shoes and will rest upon the upper surfaces of the carrier blocks. Conveniently, the carrier blocks are spring loaded inwardly towards the axis of the aperture 17 by springs not shown.

In order to move the shoes outwardly, the aforesaid upper plate not shown is provided with a depending actuating pin having a generally truncated end portion which enters into a generally complimentarily shaped recess defined by the four shoes 13, when the press is actuated. After the pin has entered the recess, continued operation of the press effects outward movement of the shoes 13 along the paths prescribed by their respective guide pins and bores.

The aforesaid guide block 16 also mounts four hydraulically operated rams 21 one of which is shown in dotted outline and which can be moved inwardly to engage with the sides of the frame to effect the required squaring up of the sides of the frame to achieve the desired rectangular form. Conveniently, the rams are supplied with hydraulic fluid under pressure from the hydraulic system of the press.

I claim:

1. A method of forming a rectangular laminated frame for an electromagnetic device comprising winding a strip of material in spiral fashion to produce a generally annular frame blank, and subjecting said blank to a forming process which includes the step of applying pressure in an outward direction at four spaced points on the internal peripheral surface of the blank, thereby to deform the blank to the required shape, the pressure being applied at the four spaced points by outwardly movable shoes, the shoes being initially positioned and the paths of movement being such that no relative slipping of the shoes and the internal peripheral surface of the blank occurs during the outward movement of the shoes.

2. A method as claimed in claim 1 including the additional step of applying pressure to the outer sides of the deformed blank or frame to square up the outer surfaces of the frame.

3. A method in accordance with claim 1 in which the outer end of the strip is secured to the adjacent turn of the blank at the end of the winding operation.

4. A method in accordance with claim 3 in which the outer end of the strip is secured by a projection welding step, the projection being formed on the strip during the cutting of the strip to the desired length.

5. An apparatus for forming a rectangular frame for an electromagnetic device from a helically wound annular blank comprising a guide block having an aperture defined therein for receiving the blank; four outwardly movable shoes located in said aperture for outward movement therein, said shoes having apical surfaces engageable with the internal surface of the blank; guide bores formed in said guide block; guide pins located in said bores and connected to respective carrier blocks which carry said shoes respectively with said shoes extending above the upper surface of said carrier blocks so that the upper surfaces of said carrier blocks serve to support the deformed blank; and means engageable with the shoes for effecting outward movement thereof.

6. An apparatus as claimed in claim 5 including an actuating pin movable into a recess defined by said shoes thereby to effect outward movement of the shoes along paths determined by the respective guide pins and bores.

7. An apparatus as claimed in claim 6 in which said pin has a tapered end, the recess defined by said shoes having a complementary shape.

8. An apparatus as claimed in claim 7 in which said guide block is mounted on a base plate for mounting on one platen of a press, said actuating pin being carried by a further plate adapted to be mounted on the other platen of the press.

9. An apparatus as claimed in claim 8 including guide means for guiding the movement of said parts.

10. An apparatus as claimed in claim 6 including fluid pressure operable rams carried by guide block and operable to engage the outer surfaces of the side walls of the frame.

11. An apparatus as claimed in claim 5 in which said apical surfaces are rounded.

* * * * *